US005199862A

United States Patent [19]

Kondo et al.

[11] Patent Number: 5,199,862

[45] Date of Patent: Apr. 6, 1993

[54] SCROLL TYPE FLUID MACHINERY WITH COUNTER WEIGHT ON DRIVE BUSHING

[75] Inventors: Hiroaki Kondo, Aichi; Takahisa Hirano, Nagoya, both of Japan

[73] Assignee: Mitsubishi Jukogyo Kabushiki Kaisha, Tokyo, Japan

[21] Appl. No.: 939,438

[22] Filed: Sep. 4, 1992

Related U.S. Application Data

[63] Continuation of Ser. No. 704,196, May 22, 1991, abandoned.

[30] Foreign Application Priority Data

Jul. 24, 1990 [JP] Japan ..... 2-195701
Aug. 28, 1990 [JP] Japan ..... 2-89969[U]

[51] Int. Cl.[5] ..... F01C 1/04; F01C 17/06; F01C 21/00

[52] U.S. Cl. ..... 418/55.1; 418/55.5; 418/57; 418/151

[58] Field of Search ..... 418/55.1, 55.5, 57, 418/151

[56] References Cited

U.S. PATENT DOCUMENTS 4,435,137 3/1984 Terauchi ..... 418/57
4,522,574 6/1985 Arai et al. ..... 418/151
4,580,956 4/1986 Takahashi et al. ..... 418/55.5
4,708,607 11/1987 Hayano et al. ..... 418/55.5
4,836,758 6/1989 Elson et al. ..... 418/55.5
5,040,958 8/1991 Arata et al. ..... 418/55.5

FOREIGN PATENT DOCUMENTS 0091544 10/1983 European Pat. Off. .
0122066 10/1984 European Pat. Off. .
0365132 4/1990 European Pat. Off. .
59-120794 7/1984 Japan ..... 418/55.5
63-061786 3/1988 Japan .
1-273890 11/1989 Japan .

*Primary Examiner*—John J. Vrablik

[57] ABSTRACT

A scroll type fluid machinery has a stationary scroll and a revolving scroll in which spiral wraps are set up at end plates, and are engaged with each other. A drive bushing is fitted rotatably into a boss projected at the central part of the outer surface of the end plate of the revolving scroll, and a drive pin projecting from the rotary shaft is fitted slidably into a slide hole bored in the drive bushing. A counter weight which generates a centrifugal force having an opposite direction to a centrifugal force acting on the revolving scroll at the time of revolving motion in a solar motion thereof is provided on the drive bushing. Further, the contact pressure between the wrap of the revolving scroll and the wrap of the stationary scroll is prevented from becoming excessive even at the time of high speed rotation of the rotary shaft.

2 Claims, 3 Drawing Sheets

SCROLL TYPE FLUID MACHINERY WITH COUNTER WEIGHT ON DRIVE BUSHING

This application is a continuation of application Ser. No. 07/704,196 filed on May 22, 1991, now abandoned.

FIELD OF THE INVENTION AND RELATED ART STATEMENT

The present invention relates to a scroll type fluid machinery used as a compressor, an expansion machinery and the like.

A radius of revolution variable mechanism for varying a radius of revolution in a solar motion of a revolving scroll automatically in accordance with the variation in gas pressure and a centrifugal force applied to the revolving scroll of a scroll type compressor has been disclosed in Japanese Patent Provisional Publication No 59-120794 (No. 120794/1984).

In this mechanism, an oscillating bearing 03 is fitted into a slide hole 02 bored on an upper end surface of a rotary shaft 01 so as to be slidable in a longitudinal direction but unable to rotate on its axis, and a pin 05 projecting downward from a central part of an underside of an end plate 04*a* of a revolving scroll 04 is inserted into this oscillating bearing 03 so as to be able to rotate relatively as shown in FIG. 5 and FIG. 6.

In FIG. 5 and FIG. 6, a spiral wrap 06*b* set up on an inner surface of an end plate 06*a* of a stationary scroll 06 is engaged mutually with a spiral wrap 04*b* set up on an inner surface of the end plate 04*a* of the revolving scroll 04 so as to delimit a compression chamber 07. A numeral 08 denotes a frame, 09 denotes a thrust bearing for supporting thrust acting on the revolving scroll 04, 010 denotes a bearing for supporting the upper end of the rotary shaft 01, $O_1$ denotes a shaft center of a rotary shaft 01, $O_2$ denotes a center of a pin 05, r denotes eccentricity between $0_1$ and $O_2$, and $\alpha$ denotes an inclination of a slide hole 02 with respect to the direction of eccentricity.

When the rotary shaft 01 is driven to rotate by a motor and the like not shown, the rotation is transmitted to the revolving scroll 04 through the slide hole 02, the oscillating bearing 03 and the pin 05. The revolving scroll 04 revolves in a solar motion while making its circular orbit with eccentricity r as a radius in a state that the rotation on its axis is checked by a mechanism for checking the rotation on its axis not shown. As a result, as a gas is suctioned into a compression chamber 07 and moves toward the center of the spiral while the compression chamber 07 is reducing the volume thereof, the gas is compressed gradually and reaches a central chamber 012, and is discharged therefrom through a discharge port 011.

A centrifugal force Fc is applied in an eccentric direction to the revolving scroll 04 by the revolution in a solar motion of the revolving scroll 04, and a gas force Fg acts in a direction which meets at right angles with the centrifugal force Fc by the gas pressure in the compression chamber 07. A composite force F of these centrifugal force Fc and gas force Fg is applied to the center $O_2$ of the pin 05.

Here, the centrifugal force Fc is expressed by the following expression (1):

$$Fc=(W/g)r\omega^2 \quad (1)$$

where,

W is the weight of the revolving scroll, r is a radius of revolution in a solar motion of the revolving scroll, $\omega$ is a revolving angular velocity of the revolving scroll, g is acceleration of gravity.

The composite force F is expressed by the following expression (2):

$$F=\sqrt{Fg^2+Fc^2} \quad (2)$$

An angle $\theta$ between the direction of the composite force F and the eccentric direction is expressed by the following expression (3):

$$\theta=tan^{-1}\{Fg/Fc\} \quad (3)$$

When the composite force F is applied to the oscillating bearing 03 through the pin 05, the oscillating bearing 03 slides in the slide hole 02 along the longitudinal direction thereof by means of a component of force F' in the longitudinal direction of the slide hole 02 of the composite force F in the direction that the radius of revolution r in a solar motion increases, and the wrap 04*b* of the revolving scroll 04 comes in contact with the wrap 06*b* of the stationary scroll 06 by means of a contact pressure force F''.

Besides, the component of force F' of the composite force F is expressed by the following expression (4):

$$F'=Fcos(\alpha+\theta) \quad (4)$$

The contact pressure force F'' is expressed by the following expression (5):

$$F''=F'cos\alpha=Fcos(\alpha+\theta)\cdot cos\alpha \quad (5)$$

In the above-mentioned conventional scroll type compressor, the centrifugal force Fc acting on the revolving scroll 04 becomes larger in accordance with increase of revolving angular velocity $\omega$ of the revolving scroll 04 as it is apparent from the expression (1). Then, when the centrifugal force Fc becomes larger, the angle $\theta$ becomes smaller as it is apparent from the expression (3). Accordingly, the component of force F' and the contact pressure force F'' become larger as it is apparent from the expressions (4) and (5).

Since the contact pressure force F'' becomes larger in proportion to a square of the revolving angular velocity $\omega$, there has been a problem that the contact pressure force F'' becomes excessive at the time of high speed rotation of the rotary shaft 01, thus increasing wear and noise of the wraps 04*b* and 06*b*.

OBJECT AND SUMMARY OF THE INVENTION

It is an object of the present invention which has been made in view of such points to provide a scroll type fluid machinery which solves the above-mentioned problems.

It is another object of the present invention to provide a scroll type fluid machinery in which the above-mentioned fluid machinery is improved further.

In order to achieve the above-described objects, the gist of the present invention is as described in the items (1) and (2), as follows.

(1) A scroll type fluid machinery in which a stationary scroll and a revolving scroll in which spiral wraps are set up at end plates, respectively, are engaged with each other, a drive bushing is fitted rotatably into a boss projected at the central part of the outer surface of the end plate of the revolving scroll, and a drive pin projecting from the rotary shaft is fitted slidably into a slide hole bored in the drive bushing, characterized in that a counter weight which generates a centrifugal force having an opposite direction to a centrifugal force acting on the revolving scroll at the time of revolving motion in a solar motion thereof is provided on the drive bushing.

The above-described construction being provided in the present invention, the counter weight generates a centrifugal force having an opposite direction to a centrifugal force acting on the revolving scroll at the time of revolving motion in a solar motion thereof. Thus, it is possible to prevent the contact pressure between the wrap of the revolving scroll and the wrap of the stationary scroll from becoming excessive notwithstanding high speed rotation of the rotary shaft.

(2) A scroll type fluid machinery in which a stationary scroll and a revolving scroll in which spiral wraps are set up at end plates, respectively, are engaged with each other, a drive bushing is fitted rotatably into a boss projected at the central part of the outer surface of the end plate of the revolving scroll, and a drive pin projecting from the rotary shaft is fitted slidably into a slide hole bored in the drive bushing, characterized in that a balance weight for balancing dynamic unbalance caused by revolving motion in a solar motion of the revolving scroll is provided on the drive bushing, and an axial position of the center of gravity of the balance weight is made to accord with the axial center of the drive bushing substantially.

The above-described construction being provided in the present invention, it is possible to prevent the contact pressure between the wrap of the revolving scroll and the wrap of the stationary scroll from becoming excessive by means of the action of the balance weight, and the moment inclined rotation of the drive bushing based on the centrifugal force working on the balance weight disappears or diminishes, thus suppressing inclined rotation of the drive bushing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 and FIG. 2 show a first embodiment of the present invention, wherein FIG. 1 is a longitudinal sectional view of a principal part and FIG. 2 is a cross-sectional view taken along a line II—II in FIG. 1.

FIG. 3 and FIG. 4 show a second embodiment of the present invention, wherein FIG. 3 is a longitudinal sectional view of a principal part and FIG. 4 is a front view in a state that the revolving scroll is removed.

FIG. 5 and FIG. 6 show an example of a conventional scroll type compressor, wherein FIG. 5 is a partial longitudinal sectional view and FIG. 6 is a cross-sectional view taken along a line VI—VI in FIG. 5.

DETAILED DESCRIPTION OF PREFERRED EMBODIMENTS

Preferred embodiments of the present invention will be described in detail illustratively with reference to the drawings.

Figure 1:
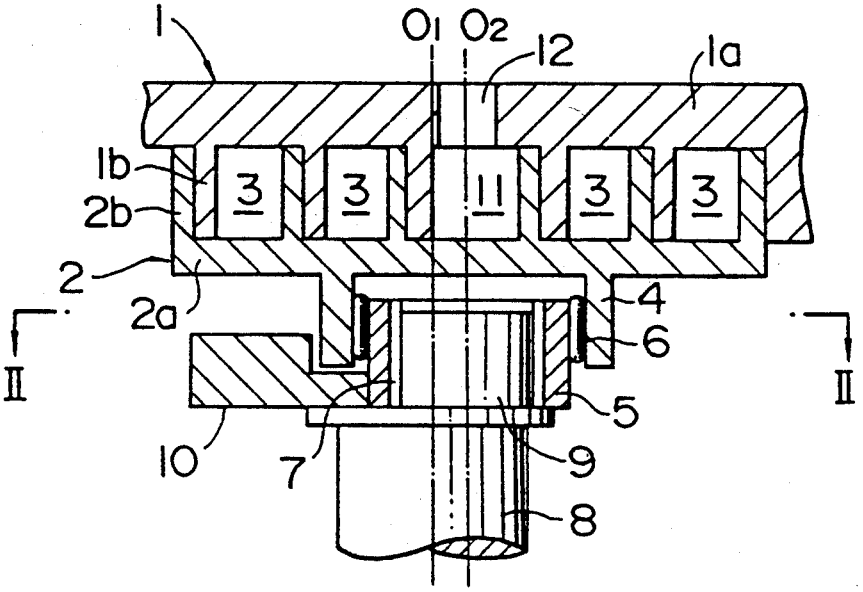
Figure 2:
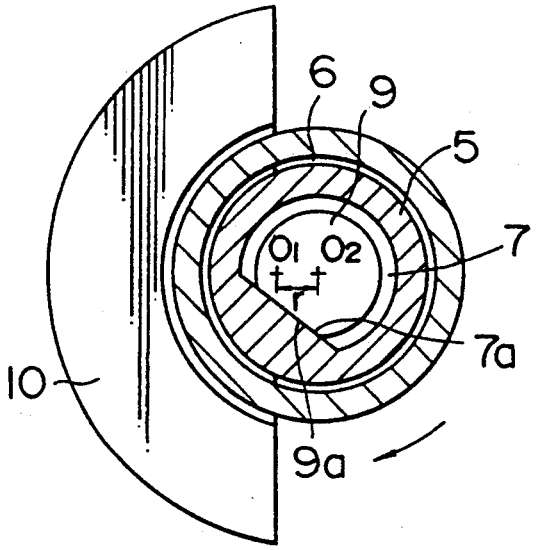

The first embodiment:

FIG. 1 and FIG. 2 show the first embodiment of the present invention.

In FIG. 1 and FIG. 2, a stationary scroll 1 consists of an end plate 1*a* and a spiral wrap 1*b* set up on the inner surface thereof. A revolving scroll 2 consists of an end plate 2*a* and a spiral wrap 2*b* set up on the inner surface thereof. The stationary scroll 1 and the revolving scroll 2 are made eccentric from each other by the radius r of revolution in a solar motion and engaged with each other as shown in the figures while shifting the angle by 180°, thereby to delimit a plurality of compression chambers 3 to form point symmetry with respect to the center of the spiral. A cylindrical boss 4 is projected at the central part of the outer surface of the end plate 2*a* of the revolving scroll 2, and a drive bushing 5 is fitted rotatably into the boss 4 through a bearing 6. A slide hole 7 is bored in the drive bushing 5, and a drive pin 9 projecting from an end surface of a rotary shaft 8 with eccentricity by r from a shaft center $0_1$ thereof is fitted into the slide hole 7. The section of the slide hole 7 is formed into a notched circle obtained by notching a circle with a straight line which is inclined in a particular direction as shown in FIG. 2. Further, the section of the eccentric drive pin 9 is also formed into a notched circle having a diameter smaller than that of the above-mentioned notched circle and having a same configuration as the notched circle. Thus, a straight line portion 9*a* of the drive pin 9 comes in contact along a straight line portion 7*a* of the slide hole 7, and thus, the drive pin 9 may slide therealong and move in all directions within a range of a clearance between the inner peripheral surface of the slide hole 7 and the outer peripheral surface of the pin 9.

Further, a counter weight 10 is attached fixedly to the drive bushing 5, and the counter weight 10 generates a centrifugal force in a direction opposite to that of a centrifugal force acting on the revolving scroll 2 at the time of revolution in a solar motion thereof.

When the rotary shaft 8 is rotated, the driving force is transmitted to the drive bushing 5 from the straight line portion 9*a* of the drive pin 9 through the straight line portion 7*a* of the slide hole 7, and transmitted further to the revolving scroll 2 through the bearing 6 and the boss 4. Thus, the revolving scroll 2 revolves in a solar motion while making a circular orbit with the eccentricity r as a radius and with the shaft center $O_1$ of the rotary shaft 8 as the center. Then, the gas taken into the compression chambers 3 is compressed gradually and reaches a central chamber 11 as the compression chambers 3 move toward the center of the spiral while reducing volumes thereof, and is discharged therefrom through a discharge port 12.

Now, with the revolution in a motion of the revolving scroll 2, an unbalanced weight consisting of the revolving scroll 2, the boss 4, the bearing 6 and the drive bushing 5 generates a centrifugal force toward the eccentric direction with respect to the shaft center $O_1$ of the rotary shaft 8 and the center $O_2$ of the drive bushing 5, but a centrifugal force in a direction opposite to that of the above-mentioned centrifugal force is generated at the same time in the counter weight 10.

Thus, it is possible to make a force which presses the side surface of the spiral wrap 2*b* of the revolving scroll 2 against the side surface of the spiral wrap 1*b* of the stationary scroll 1, viz., the contact a pressure force constant irrespective of the number of rotations of the rotary shaft 8.

Thus, since a counter weight which generates a centrifugal force in a direction opposite to that of the centrifugal force acting on the revolving scroll at the time of revolution in a solar motion thereof is provided on the drive bushing, it is possible to prevent the contact pressure force between the wrap of the revolving scroll and the wrap of the stationary scroll from becoming excessive even at the time of high speed rotation of the rotary shaft.

As a result, abnormal wear of the wrap can be prevented. Therefore, it is possible to prevent lowering of performance of a scroll type fluid machinery as well as to extend the life thereof.

The second embodiment:

In the scroll type fluid machinery shown in FIG. 1 of the above-described first embodiment, the axial position of the center of gravity G of the balance weight 10 is located at a lower part in an axial direction of the drive bushing 5, and the drive bushing 5 and the balance weight 10 are just placed so as to slide on the upper end surface of the rotary shaft 8 and the eccentric drive pin 9 is just fitted into the slide hole 7 slidably. Therefore, the balance weight 10 and the drive bushing 5 formed in one body therewith are rotated inclining clockwise in FIG. 1 by the centrifugal force F acting on the center of gravity of the balance weight 10 at the time of revolution in a solar motion of the revolving scroll 2. As a result, there have been such problems that offset working is produced on the rotary bearing 6 and the lower end surface of the drive bushing 5 also works on the upper end face of the rotary shaft 8 in an offset manner.

The present invention also provides a scroll type fluid machinery in which the above-described problems are solved.

Figure 3:
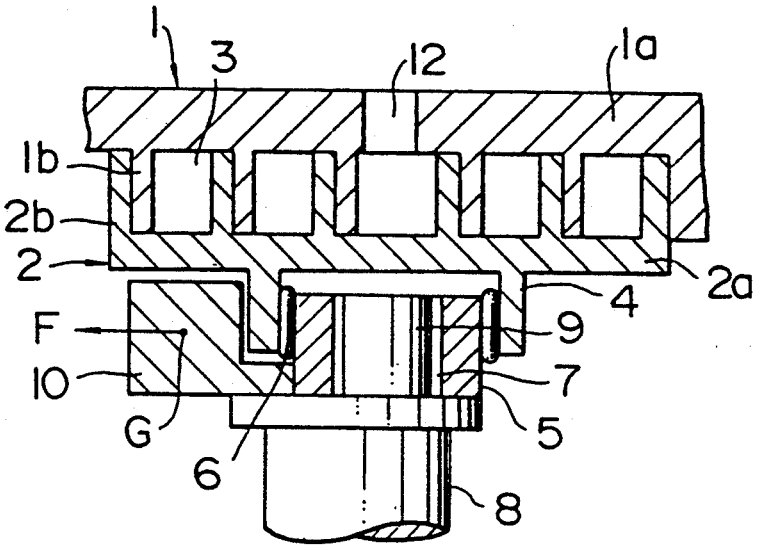
Figure 4:
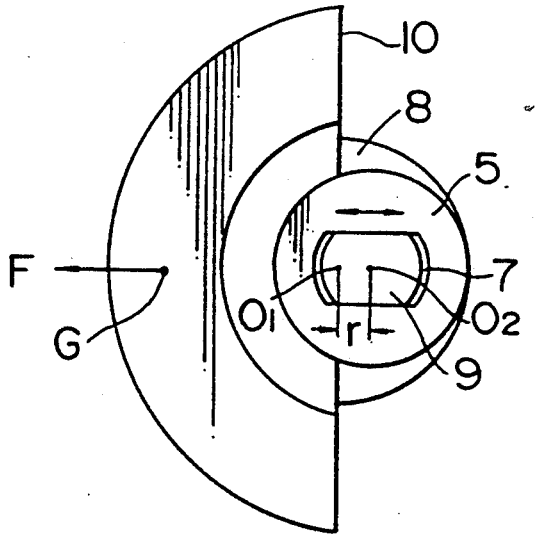
Figure 5:
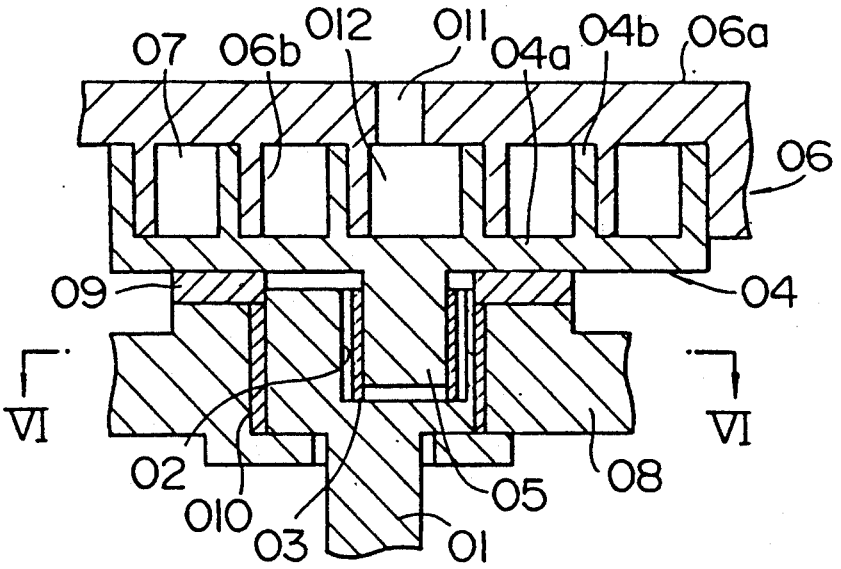
FIG. 5 PRIOR ART
Figure 6:
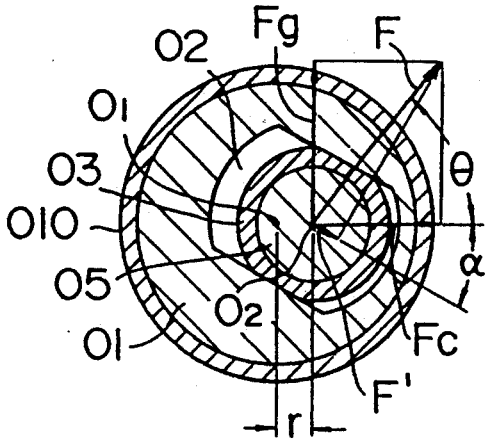
FIG. 6 PRIOR ART

FIG. 3 and FIG. 4 show a second embodiment of the present invention.

As shown in FIG. 3 and FIG. 4, the axial position of the center of gravity G of the balance weight 10 is made to almost accord with the center in an axial direction of the drive bushing 5 by increasing the thickness in a vertical direction of the balance weight 10.

Other construction is almost similar to those shown in FIG. 1 and FIG. 2, and same symbols are assigned to corresponding members.

At the time of revolution in a solar motion of the revolving scroll 2, the drive bushing 5 and the balance weight 10 fixed thereto also revolves in a solar motion with the above-mentioned revolving motion, and a centrifugal force F acts on the balance weight 10 at the center of gravity G. Since the axial position of the center of gravity G is in accord with the center in an axial direction of the drive bushing 5 substantially, however, the moment of inclined rotation of the drive bushing 5 based on the centrifugal force F disappears or reduces remarkably.

In the present invention, the axial position of the center of gravity of the balance weight is made to accord substantially with the axial center of the drive bushing as described above. Thus, the moment of inclined rotation of the drive bushing based on the centrifugal force acting on the balance weight disappears or reduces, thus suppressing inclined rotation of the drive bushing.

As a result, it is possible to prevent offset working of a rotary bearing which supports the drive bushing and offset working of the end surface of the drive bushing against the end surface of the rotary shaft so as to prevent abnormal wear and damages caused by above-mentioned offset working, thereby to improve reliability of a scroll type fluid machinery.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A scroll type fluid machinery comprising a stationary scroll and a revolving scroll having spiral warps set up at end plates, respectively, the spiral wraps being engaged with each other, a drive bushing being fitted rotatably into a boss projected at a central part of an outer surface of the end plate of said revolving scroll, a drive pin projecting from a rotary shaft being fitted slidably into a slide hole bored in the drive bushing, a cross section of the slide hole having a notched circular shape and the drive pin having a notched circular shape corresponding to the shape of the slide hole but with a smaller circumference, both the slide hole and drive pin having generally straight line portions which mate with one another, and a balance weight being directly attached to the drive bushing, the balance weight balancing dynamic unbalance caused by revolving motion in a solar motion of said revolving scroll, and an axial position of the center of gravity of said balance weight being made to substantially accord with the axial center of said drive bushing to thereby reduce a moment of inclined rotation of the drive bushing resulting from centrifugal force during rotation thereof, the generally straight line portions of the drive pin slide along the generally straight line portions of the slide hole during rotation of the revolving scroll.

2. The scroll type fluid machinery according to claim 1, wherein the balance weight has a generally semicircular shape.

* * * * *